US006971845B2

(12) United States Patent
Weaver

(10) Patent No.: US 6,971,845 B2
(45) Date of Patent: Dec. 6, 2005

(54) VANE WITH MODIFIED BASE

(75) Inventor: Kevin J Weaver, Clevedon (GB)

(73) Assignee: Rolls-Royce PLC, London (GB)

( * ) Notice: Subject to any disclaimer, the term of this patent is extended or adjusted under 35 U.S.C. 154(b) by 59 days.

(21) Appl. No.: 10/687,773

(22) Filed: Oct. 20, 2003

(65) Prior Publication Data

US 2004/0141839 A1 Jul. 22, 2004

(30) Foreign Application Priority Data

Nov. 15, 2002 (GB) ..... 0226690

(51) Int. Cl.[7] ..... F01D 9/02
(52) U.S. Cl. ..... 415/189; 415/191
(58) Field of Search ..... 415/189, 190, 415/191, 192, 182.1, 183, 185, 209.3, 209.4

(56) References Cited

U.S. PATENT DOCUMENTS 4,706,354 A 11/1987 Naudet et al.
5,017,092 A 5/1991 Violette et al.
5,494,404 A * 2/1996 Furseth et al. ..... 415/209.3
5,605,440 A 2/1997 Bocoviz et al.

FOREIGN PATENT DOCUMENTS

EP 0 133 845 A2 3/1985
EP 1 076 159 A2 2/2001
GB 813522 5/1959

* cited by examiner

*Primary Examiner*—Edward K. Look
*Assistant Examiner*—Richard A. Edgar
(74) *Attorney, Agent, or Firm*—Oliff Berridge, PLC

(57) ABSTRACT

A guide vane 1, such as may be used in a guide vane stage of a compressor (not shown), the guide vane comprising a main body 2 and a mounting base 4. In one aspect of the invention, at least part 22 of the mounting base 4 is aerofoil shaped.

In another aspect of the invention, the mounting base 4 projects outwardly beyond a surface 14 of the main body 2 on one side only of the guide vane 1.

8 Claims, 4 Drawing Sheets

VANE WITH MODIFIED BASE

This invention relates to a vane with a modified base. Particularly, although not exclusively, the invention relates to a guide vane having an aerofoil shaped base for use in a gas turbine engine.

Guide vanes are used in the guide vane stage of the compressor of a gas turbine engine. A conventional guide vane stage comprises an outer support ring concentric with an inner support ring, the rings being connected together by a plurality of radially disposed guide vanes. The vanes are provided with bases (or platforms) at each end, which engage in the rings. The guide vane stage directs the flow of air through the compressor.

Conventional vanes have a substantially blade shaped main body integrally formed at its ends with mounting bases which project substantially equidistantly from both sides of the main body. The mounting bases may be machined directly from a blank or may be forged with excess material which has to be machined and hand blended. In certain applications, the radially outer surface of the radially inner mounting base may extend at an acute angle relative to the main body of the vane, so that the outer surface of the mounting base may be difficult to forge or machine in the confined space defined between the radially outer surface of the mounting base and the adjacent portion of the main body of the vane.

According to a first aspect of the present invention, there is provided a guide vane for a compressor comprising a main body and a mounting base, said mounting base being provided with formations which engage with co-operating formations provided on the compressor, wherein at least part of the mounting base is aerofoil shaped and at least part of the said mounting base projects outwardly beyond a surface of the main body on one side only of the vane.

Preferably the vane is formed in an aerofoil shape by forging.

Preferably, an entire side of the main body and mounting base is aerofoil shaped.

Preferably, the surface of the mounting base adjacent the main body forms an obtuse angle with the main body.

Preferably, the mounting base is integrally formed with the main body.

Preferably, the surface of the main body opposite to the side from which the mounting base projects is continuous with a side of the mounting base.

Preferably, the vane comprises a fluid guide vane, such as may be used in a guide vane stage of a compressor for a gas turbine engine.

Preferably, the surface of the main body opposite to the side from which the mounting base projects and an adjacent surface of the mounting base have a substantially continuous profile.

Preferably, mounting bases are formed at both ends of the vane. Preferably, each mounting base projects outwardly beyond a surface of the main body on one side only of the vane.

For a better understanding of the present invention, and to show more clearly how it may be carried into effect, reference will now be made, by way of example, to the accompanying drawings, in which.

Figure 1:
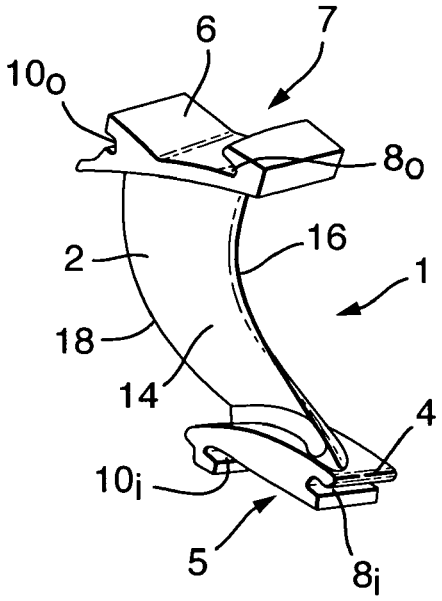
Fig.1. Prior Art
FIG. 1 is a perspective view of a conventional guide vane.
Figure 2:
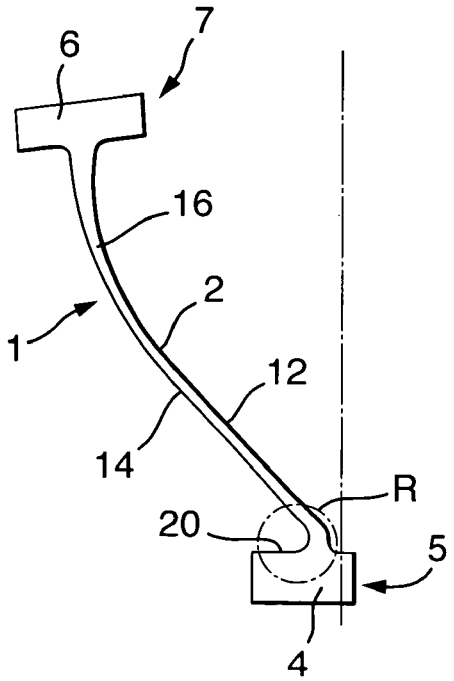
Fig.2. Prior Art
FIG. 2 is a cross-section through the guide vane of FIG. 1.
Figure 3:
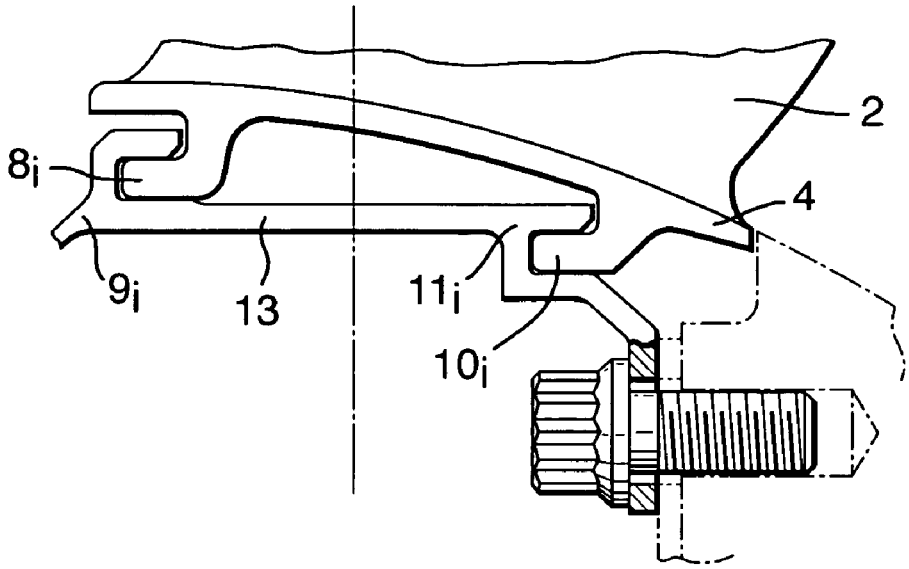
Fig.3. Prior Art
FIG. 3 is a cross section through the inner mounting base of the guide vane of FIG. 1.

FIGS. 1 and 2 show a conventional guide vane 1 comprising a main body 2 which is integrally formed with an inner mounting base (or vane platform) 4 at its radially inner end 5, and an outer mounting base (or vane platform) 6 at its radially outer end 7. As shown in FIG. 3 the inner mounting base 4 is provided with formations (8*i*, 10*i*) which engage with cooperating formations (9*i*, 11*i*) formed on a radially inner guide ring 13 of a compressor structure.

Figure 4:
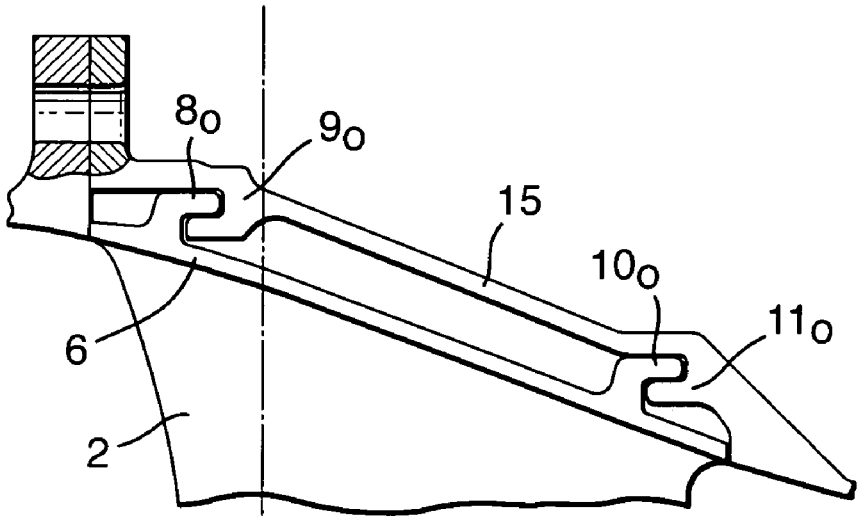
Fig.4. Prior Art
FIG. 4 is a cross section through the outer mounting base of the guide vane of FIG. 1.
Figure 5:
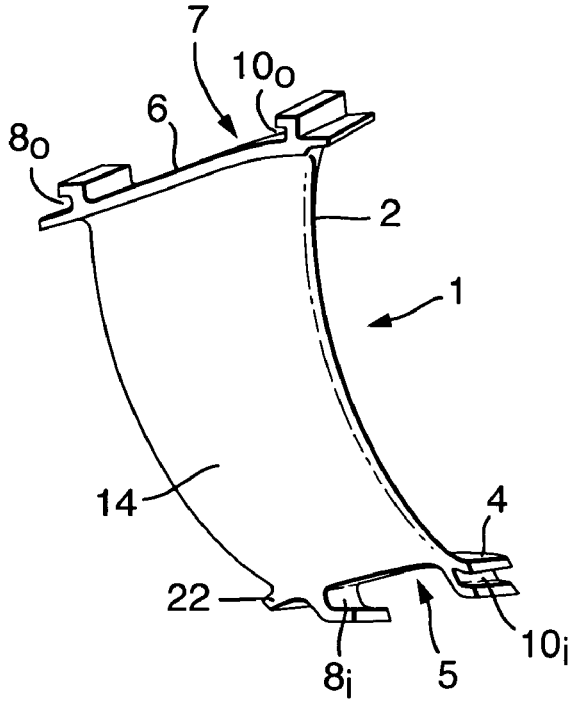
FIG. 5 is a perspective view of a guide vane having an offset mounting base at its lower end.
Figure 6:
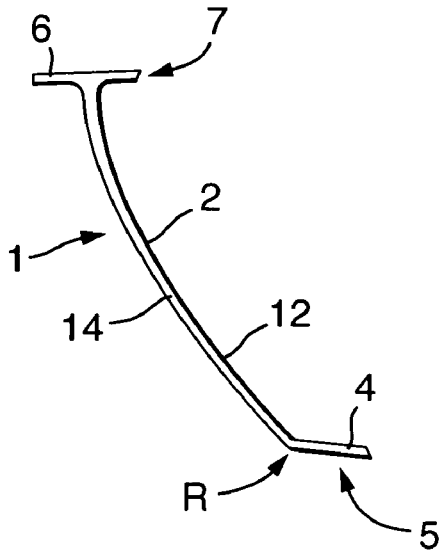
FIG. 6 is a cross-section through the guide vane of FIG. 5.
Figure 7:
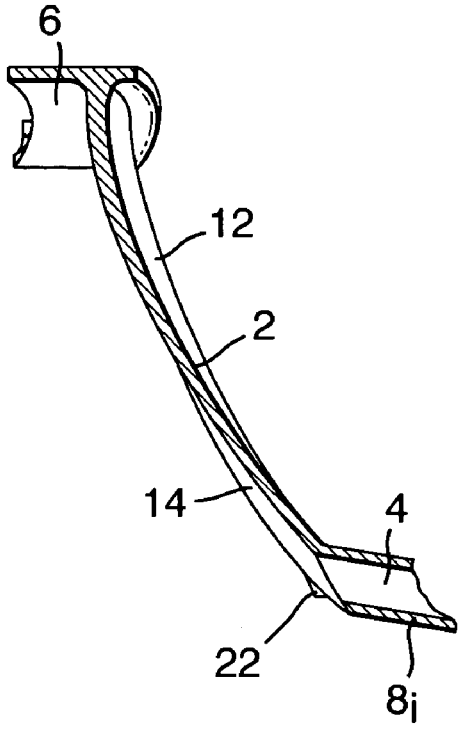
FIG. 7 is a perspective view of the guide vane of FIG. 5 taken along a centreline of the guide vane.
Figure 8:
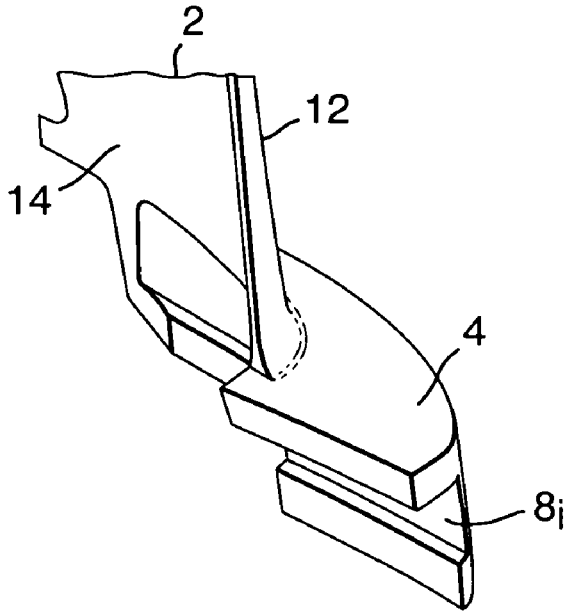
FIG. 8 is an enlarged perspective view of the inner end of the guide vane of FIG. 5.

Likewise, as shown in FIG. 4 the outer mounting base 6 is provided with formations (8*o*, 10*o*) which engage with co-operating formations (9*o*, 11*o*) formed on a radially outer guide ring 15 of a compressor structure.

The main body 2 of the guide vane 1 is generally blade shaped, comprising first and second aerofoil surfaces 12, 14 extending between first and second edges 16, 18. The first aerofoil surface 12 is substantially convex in a circumferential direction and concave in a radial direction, whereas the second aerofoil surface 14 is substantially concave in a circumferential direction and convex in a radial direction. Also, the body portion 2 has a slight aerofoil twist to enable machine tool access to a radially outer surface 20 of the inner mounting base 4 in the region R indicated by a circle in FIG. 2. This aerofoil twist is necessary because the outer surface 20 of the inner mounting base 4 forms an acute angle with the second aerofoil surface 14 of the main body 2, which results in restricted access to the outer surface 20 of the inner mounting base 4.

As best shown in FIG. 2, the inner mounting base 4 projects beyond the first aerofoil surface 12 and the second aerofoil surface 14 of the main body 2. Similarly, the outer mounting base 6 projects beyond the first aerofoil surface 12 and the second aerofoil surface 14 of the main body 2. Consequently, once the main body 2 has been forged, together with the inner mounting base 4 and outer mounting base 6, it is necessary to machine both mounting bases 4, 6 on both sides of the main body portion 2. This process is time consuming and expensive, particularly because machining has to be carried out in the region R mentioned above, in which machine tool access is restricted.

FIGS. 5 to 8 show a guide vane which is substantially identical to the guide vane illustrated in FIGS. 1 to 4, apart from the shape of the inner mounting base 4. In this embodiment, like parts are given the same reference numbers as in the prior art arrangement described above.

In the embodiment of FIGS. 5 to 8, the second aerofoil surface 14 is continuous with a side 22 of the inner mounting base 4, so that the inner mounting base 4 only projects beyond the first aerofoil surface 12. Consequently, the machining problem identified above in relation to the prior art arrangement is completely removed. Indeed, machining may not be required at all to form the inner mounting base in the region R adjacent the second aerofoil surface 14. Furthermore, the entire second aerofoil surface 14 and adjoining side 22 of the inner mounting base 4 can be made aerofoil shaped simply in a forging operation, so that no machining (or at least only minimal machining or hand blending) is required to form a finished surface. Also the air flow over the finished vane 1 of the present invention is smoother than in the prior art arrangement, particularly in the transition region between the main body 2 and the adjoining surface of the inner mounting base 4.

Although in the illustrated embodiment, only the inner mounting base 4 is modified, it will be appreciated that the outer mounting base 6 could be modified instead, or in addition.

It will be appreciated that a vane produced without re-entrant features, (for example, in the embodiments shown the acute angle between the mounting base and the main body of the vane) is a simpler shape to forge since there are fewer sharp/acute angles to produce. Additionally a component produced without such acute/sharp angles is easier to extract from a forging die.

It will also be appreciated that the invention has particular efficacy in the manufacture of vanes made by casting methods since a vane produced without re-entrant features (for example, in the embodiments shown, the acute angle between the mounting base and the main body of the vane) is easier to extract from a casting die or mould. Regardless of whether the vane is manufactured from a predominantly metallic material or manufactured from a non metallic or composite material, the absence of re-entrant features will simplify the manufacture of the vane.

The configurations shown in the accompanying drawings are diagrammatic. The design of the elements comprising the invention may vary between designs. Likewise the configurations and relative positioning of the described components may differ in different embodiments of the invention.

What is claimed is:

1. A guide vane for a compressor, comprising:

an aerofoil shaped main body; and a mounting base formed on at least one end of the main body, said mounting base being provided with formations which engage with co-operating formations provided on the compressor, wherein at least one mounting base and formations extend sideways away from the main body in one direction only, and a side of the main body, mounting base and a side of the formations opposite a side from which the mounting base and formations project, continue in the same plane as the surface of the main body.

2. A vane as claimed in claim 1 in which an entire side of the main body and mounting base is aerofoil shaped.

3. A vane as claimed in claim 1, in which the aerofoil shape is formed by forging.

4. A vane as claimed in claim 1, in which the surface of the mounting base adjacent the main body forms an obtuse angle with the main body.

5. A vane as claimed in claim 1, in which the mounting base is integrally formed with the main body.

6. A vane as claimed in claim 1, in which the surface of the main body opposite to the side from which the mounting base projects is continuous with a side of the mounting base.

7. A vane as claimed in claim 1, in which the surface of the main body opposite to the side from which the mounting base projects and an adjacent surface of the mounting base have a substantially continuous profile.

8. A vane as claimed in claim 1 wherein the vane forms part of a gas turbine engine.

* * * * *